US010332489B2

(12) United States Patent
Croxford et al.

(10) Patent No.: US 10,332,489 B2
(45) Date of Patent: Jun. 25, 2019

(54) DATA PROCESSING SYSTEM FOR DISPLAY UNDERRUN RECOVERY

(71) Applicant: ARM Limited, Cambridge (GB)

(72) Inventors: Daren Croxford, Swaffham Prior (GB); Jayavarapu Srinivasa Rao, Cambridge (GB)

(73) Assignee: Arm Limited, Cambridge (GB)

( * ) Notice: Subject to any disclaimer, the term of this patent is extended or adjusted under 35 U.S.C. 154(b) by 0 days.

(21) Appl. No.: 15/469,504

(22) Filed: Mar. 25, 2017

(65) Prior Publication Data

US 2017/0301319 A1 Oct. 19, 2017

(30) Foreign Application Priority Data

Apr. 13, 2016 (GB) ..... 1606394.3

(51) Int. Cl.
*G09G 5/395* (2006.01)
*G09G 3/20* (2006.01)
*G09G 5/391* (2006.01)

(52) U.S. Cl.
CPC ..... *G09G 5/395* (2013.01); *G09G 3/2096* (2013.01); *G09G 5/391* (2013.01); *G09G 2310/08* (2013.01); *G09G 2360/12* (2013.01); *G09G 2360/18* (2013.01)

(58) Field of Classification Search
CPC ..... G06T 1/60
USPC ..... 345/520
See application file for complete search history.

(56) References Cited

U.S. PATENT DOCUMENTS 6,160,847 A * 12/2000 Wu ..... G06T 9/007 348/419.1
8,125,490 B1 * 2/2012 Vaidya ..... G09G 5/393 345/503
2002/0194609 A1 * 12/2002 Tran ..... H04N 21/42692 725/95
2006/0125835 A1 * 6/2006 Sha ..... G09G 5/391 345/560
2007/0177808 A1 * 8/2007 Ando ..... H04N 19/176 382/232

(Continued)

FOREIGN PATENT DOCUMENTS

EP 2665239 A1 11/2013

OTHER PUBLICATIONS

Search Report dated Jul. 19, 2017, in GB Patent Application GB 1606394.3.

(Continued)

*Primary Examiner* — Phong X Nguyen
(74) *Attorney, Agent, or Firm* — Vierra Magen Marcus LLP

(57) ABSTRACT

A display controller of a data processing system fetches data for surfaces to be displayed from memory of the data processing system into a local buffer or buffers of the display controller and provides that data from the local buffer or buffers of the display controller to a display for display. If the display controller determines that data to be provided to the display has not been fetched into a local buffer of the display controller, it provides data that has previously been fetched into the local buffer of the display controller to the display in place of the data that has not been fetched into a local buffer of the display controller.

11 Claims, 9 Drawing Sheets

(56) References Cited

U.S. PATENT DOCUMENTS

| | | | | |
|---|---|---|---|---|
| 2009/0102849 | A1* | 4/2009 | Khodorkovsky | G09G 5/393 345/538 |
| 2010/0073388 | A1* | 3/2010 | Mostinski | G09G 5/363 345/558 |
| 2011/0148889 | A1* | 6/2011 | Carter | G09G 5/006 345/506 |
| 2011/0169849 | A1* | 7/2011 | Bratt | G09G 5/39 345/545 |
| 2012/0054383 | A1* | 3/2012 | Lindahl | G06F 1/3215 710/57 |
| 2013/0066451 | A1* | 3/2013 | Ganesan | H04B 1/0007 700/94 |
| 2015/0134784 | A1* | 5/2015 | De Vleeschauwer | H04L 65/605 709/219 |
| 2015/0379772 | A1* | 12/2015 | Hoffman | G06T 19/006 345/633 |
| 2016/0234506 | A1* | 8/2016 | Wang | H04N 19/152 |
| 2016/0240172 | A1* | 8/2016 | Singh | G09G 5/363 |
| 2016/0292814 | A1* | 10/2016 | Holland | H04N 21/44008 |
| 2017/0289246 | A1* | 10/2017 | Gates | H04L 65/4084 |

OTHER PUBLICATIONS

Combined Search and Examination Report dated Oct. 14, 2016, GB Patent Application GB1606394.3.

* cited by examiner

DATA PROCESSING SYSTEM FOR DISPLAY UNDERRUN RECOVERY

BACKGROUND

The technology described herein relates to data processing systems and in particular to display controllers for data processing systems.

FIG. 1 shows an example data processing system that comprises a central processing unit (CPU) 7, a graphics processing unit (GPU) 2, a video codec 1, a display controller 5, and a memory controller 8. As shown in FIG. 1, these units communicate via an interconnect 9 and have access to off-chip memory 3. In use of this system the GPU 2, video codec 1 and/or CPU 7 will generate surfaces (images) to be displayed and store them, via the memory controller 8, in respective frame buffers in the off-chip memory 3. The display controller 5 will then read those surfaces as input layers from the frame buffers in the off-chip memory 3 via the memory controller 8, process the input surfaces appropriately and send them to a display 4 for display.

FIG. 2 shows an example data path for the processing of the input surfaces for display in the display controller 5. It is assumed in this example that the display controller 5 can take as inputs for a given output surface to be displayed a plurality of input surfaces (layers), and includes, inter alia, a composition engine (stage) 22 that is able to compose one or more input surfaces (layers) (e.g. generated by the GPU 2 and/or video codec 1) to provide a composited output frame for display.

As shown in FIG. 2, the display controller includes a DMA (Direct Memory Access) read unit 20 that reads data of input surfaces to be displayed and provides it appropriately to local buffers of the display controller, in the form of respective sets of latency "hiding" FIFOs 21. (The latency hiding FIFOs 21 provide "latency" buffering in the display processing path to allow for potential latency in retrieving the required input surface data from memory. There is one set of latency FIFOs 21 for each "layer" that the display controller can take as an input for its processing.)

The input surfaces that the display controller 5 processes to provide the output surface for display will be generated, as discussed above, e.g. by the video codec 1, CPU 7 and/or GPU 2 of the overall data processing system, and stored as respective frame buffers in the main memory 3 of the data processing system.

When a frame is to be displayed, the input surfaces that form the input layers are composed in the display composition stage 22 to provide a composited output surface for display. The composited output surface (i.e. the frame that is to be displayed) is then subject to display timing control 23 (e.g. the inclusion of appropriate horizontal and vertical blanking periods), and then provided to the display output interface of the display controller 5 for provision to the display 4 for display.

This process is repeated for each frame that needs to be displayed, e.g. at a rate of 30 or 60 frames per second.

As such display processing is a real-time operation, the display controller 5 needs to deliver the pixel data to be displayed to the display 4 (to the display output) regularly, in each clock cycle triggering the display output from the display controller.

Thus a generally desirable feature of the operation of a display controller when displaying a frame is the ability to fetch the data for the layer or layers making up the frame to be displayed, such that the display can be kept updated in real time with new data at the required rate. If the data required to be displayed cannot be fetched sufficiently quickly, then there may be no current data available for display, such that an error will then occur. This is often referred to "underrun", and will result in incorrect data being displayed.

Such "under-run" can occur, for example, because of latencies in fetching the input surface data from memory, such that the required data has not been fetched and/or has not completed its processing, by the time it is required to be displayed.

It is accordingly known to try to design display controllers and data processing systems to reduce or avoid the risk of underrun. For example, display controllers may comprise, as discussed above, sets of "latency hiding" buffers into which data to be displayed is fetched in advance of displaying that data. This can help to ensure that there is always sufficient data "local" to the display controller for display, even if there are delays in fetching data from main memory where it is stored.

It is also known to try to reduce the amount of data that must be fetched for displaying a given frame, for example by "pre-compositing" ("flattening") a number of layers to be displayed (e.g. using a graphics processing unit), in advance of providing the layers to the display controller for display. However, this can increase power consumption, memory bandwidth and loading on the GPU.

It is also known to try to prioritise memory transactions for display controller operations to try to ensure that the required data for display will be available to the display controller when it is required.

Notwithstanding these techniques, the Applicants believe that there remains scope for improvements to the operation of display controllers and data processing systems, in particular in relation to the issue of "underrun".

BRIEF DESCRIPTION OF THE DRAWINGS

Various embodiments of the technology described herein will now be described by way of example only and with reference to the accompanying drawings, in which.

Like reference numerals are used for like components throughout the drawings, where appropriate.

DETAILED DESCRIPTION

Figure 1:
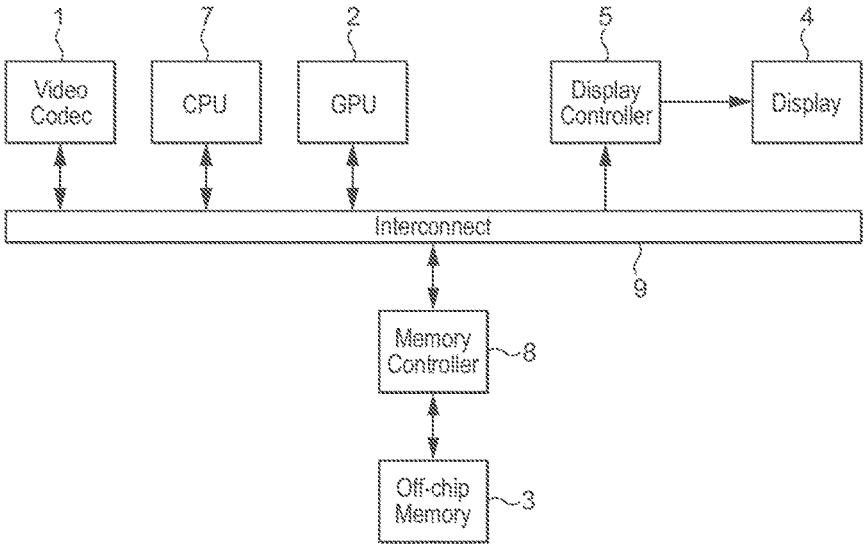
FIG. 1 (PRIOR ART)
FIG. 1 shows an example data processing system.
Figure 2:
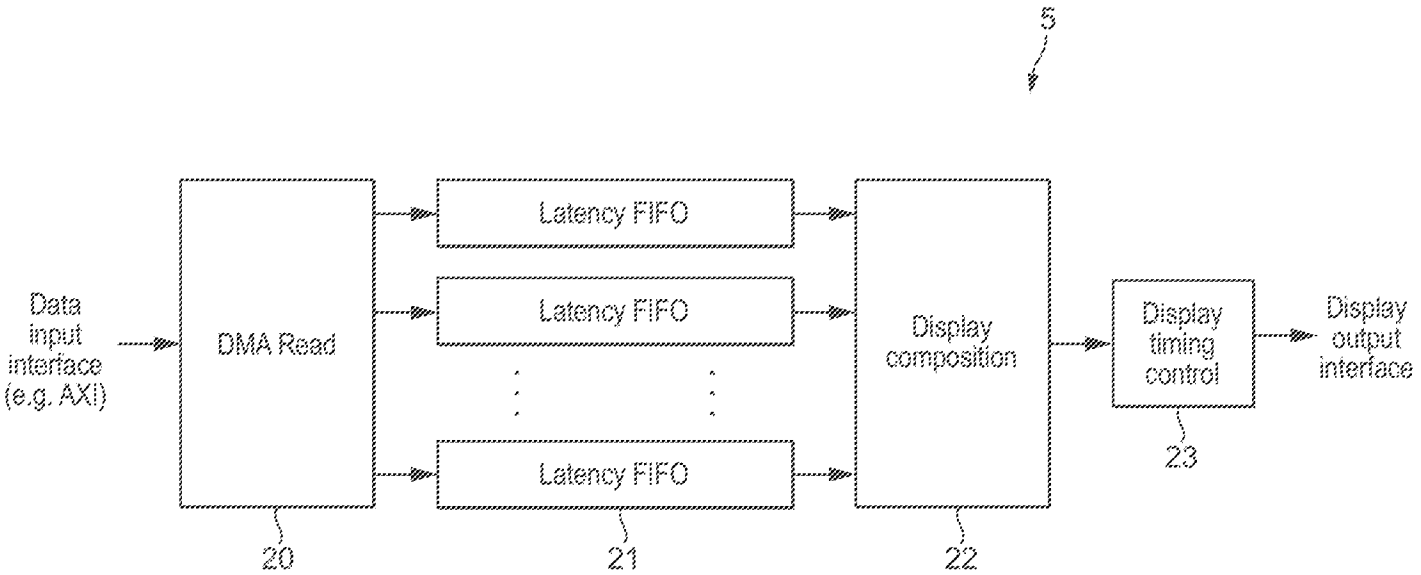
FIG. 2 (PRIOR ART)
FIG. 2 shows schematically the data-flow in a display controller.

An embodiment of the technology described herein comprises a method of operating a display controller of a data processing system, the display controller being operable to fetch data for surfaces to be displayed from memory of the data processing system into a local buffer or buffers of the display controller and to provide data from the local buffer or buffers of the display controller to a display for display, the method comprising:

the display controller, when fetching data from memory for display and providing that data to a display for display:

determining whether data to be provided to the display has been fetched into a local buffer of the display controller or not;

and when it is determined that data to be provided to the display has not been fetched into a local buffer of the display controller, providing to the display in place of the data that has not been fetched into a local buffer of the display controller, data that has previously been fetched into the local buffer of the display controller.

Another embodiment of the technology described herein comprises a display controller for a data processing system, the display controller comprising:

one or more local buffers;

a memory read sub-system operable to fetch data of input surfaces to be processed by the display controller from memory into the local buffer or buffers of the display controller; and one or more processing stages operable to provide data from the local buffer or buffers of the display controller to a display for display;

wherein:

the display controller is operable to, when fetching data from memory for display and providing that data to a display for display:

determine whether data to be provided to the display has been fetched into a local buffer of the display controller or not;

and when it is determined that data to be provided to the display has not been fetched into a local buffer of the display controller, provide to the display in place of the data that has not been fetched into a local buffer of the display controller, data that has previously been fetched into the local buffer of the display controller.

The technology described herein relates to a display controller operation, and in particular to the operation of a display controller when it is determined that data to be provided to the display that the display controller is acting for has not been fetched from memory (i.e. that "underrun" such that pixel data is not available in time for display, has or is likely to occur). When such "underrun" is detected, the display controller operates to provide data that has previously been fetched from memory to the display for display. As will be discussed further below, that previously fetched data may be, and in embodiments is, data from a previously displayed line in the current layer (and thus frame) being displayed, and/or data from the corresponding line in a previously displayed layer (output frame).

In other words, the technology described herein operates to reuse data that has previously been fetched into the local buffer of the display controller and provided to the display for display by the display controller, in place of data that is "missing" because of underrun when fetching new data for display.

The Applicants have recognised in this regard that displaying previously fetched data in place of "missing" data when underrun occurs in a display processing operation can provide a more visually acceptable and potentially imperceptible correction of the effects of underrun, in contrast, e.g., to simply displaying some form of background or default colour, or some other form of error when underrun occurs.

In particular, the Applicants have recognised that when an image is to be displayed, a previous line of a frame is likely to be similar to the next line to be displayed, and/or the corresponding line of pixels in a previous frame is likely to be similar to the corresponding line of pixels in the next frame, such that repeating a previous line or a line from a previous frame when underrun occurs is likely to have less visual impact. The technology described herein can accordingly provide a method and apparatus that is able to recover from display controller underrun with, potentially significantly, reduced impact on the experience of the user viewing the displayed frames.

The technology described herein accordingly provides a method and apparatus that is able to make underrun, should it occur, in a display controller operation less noticeable to a user. Additionally, because the technology described herein is able to make underrun less noticeable, that can allow the display controller and/or memory system correspondingly to be implemented with a (potentially) higher risk of underrun occurring (i.e. reduces the need for imposing constraints on the display controller and memory system design so as to try to avoid underrun), because any underrun that does occur can instead be compensated for by the technology described herein. That will then allow, for example, the display controller and/or overall memory system to be, for example, designed to optimise other parameters such as, efficiency, power consumption and silicon area, instead of being constrained by the need to reduce the risk of underrun to such a large extent. It can also allow display controllers and/or memory systems that may, e.g., due to design implementation issues, have a higher risk of underrun still to be usable.

The memory of the data processing system that the data for surfaces to be displayed is fetched from can be any suitable and desired memory of the data processing system that the display controller is part of. It is in an embodiment a main memory of the overall data processing system. Each input surface is in an embodiment stored in (and fetched from) a frame buffer.

The local buffer of the display controller that the input surface data is fetched into can be any suitable and desired local buffer memory of or accessible to the display controller. This may depend on the design of the display controller and its associated display.

In one embodiment, the local buffer(s) is a latency hiding buffer of the display controller (and thus the display controller comprises one or more latency hiding buffers), e.g., and in an embodiment that is able to store one or more lines of sampling position (pixel position) data for a surface. The latency hiding buffers are in an embodiment linear buffers, such as a latency-hiding FIFO. The local buffer may also be or instead comprise another, e.g. linear, buffer of the display controller, such as an output buffer.

In another embodiment, the local buffer comprises a frame buffer that is provided locally to (that is integrated with) the display that the display controller is controlling (providing data for display to). This may be the case where the display controller and display support "partial update" operation.

The occurrence of underrun (i.e. that data to be provided to the display has not been fetched into a local buffer of the display controller (i.e. that pixel data is not available in time for display)) can be determined (detected) in any suitable and desired manner. This may, e.g., and does in an embodiment, depend upon the way that the display controller operates.

For example, where the display controller includes latency hiding buffers (e.g. latency FIFOs), then underrun can be detected when the latency hiding buffer in question is or becomes empty, and/or contains less than a threshold amount of data (e.g. sampling point (pixel) positions), e.g., and in an embodiment, for a line of a surface to be displayed. Thus, in an embodiment, "underrun" is detected when a latency hiding (or other linear) buffer of the display controller is or becomes empty, and/or contains less than a threshold amount of data (e.g. sampling point (pixel) positions), e.g., and in an embodiment, for a line of a surface to be displayed.

Where the display controller and its corresponding display is configured such that the display (the display panel) has its own (integrated) frame buffer memory, then underrun can be, and in an embodiment is, determined to be occurring when it is determined that data to be provided to update the frame buffer of the display panel is not available. This may, e.g. in an embodiment, be determined when, a latency hiding buffer or buffers of the display controller is, or is at risk of, becoming empty.

In one embodiment the occurrence of underrun (i.e. that data to be provided to the display has not been fetched into a local buffer of the display controller) is determined by determining whether data to be read from the local buffer of the display controller and provided to the display was present in the local buffer of the display controller when a read operation for that data was performed.

In another embodiment, the display controller keeps track of the fetching of data from memory for display, and determines therefrom whether data to be provided to the display has been fetched from memory or not. This may be done in any suitable and desired manner. For example, the amount of data that is ready to be provided to the display that has been fetched from memory into the local buffer could be tracked (e.g. by using a counter), with it then being determined when the amount of data that has been fetched falls below a given, in an embodiment selected, and in an embodiment predetermined, threshold value (which could be zero but is in an embodiment a value greater than zero).

Thus, in an embodiment a record (e.g. a count) of the amount of newly fetched data from memory that is able to be provided to the display is maintained, and when that amount of "in advance" fetched data falls below a threshold amount, it is determined that "underrun" has occurred (for the purposes of the operation of the technology described herein).

As discussed above, in the technology described herein, when it is determined that data to be provided to the display has not been fetched from memory (i.e. the occurrence of underrun is determined), data that has previously been fetched into the local buffer of the display controller (i.e. that is already stored in the local buffer of the display controller) is provided to the display in place of the "missing" data that should have been provided to the display. Again, this operation can be performed in any suitable and desired manner, and may, and in an embodiment does, depend upon the overall operation of the display processor and its associated display.

Thus, for example, where the display panel has its own (integrated) local frame buffer memory that stores the data to be displayed, the already stored data for the pixel positions in question in the frame buffer of the display panel is in an embodiment displayed in place of the "missing" (not-fetched) new data for those pixel positions. In this case therefore, the data that has previously been fetched into the local buffer (that has previously been provided to the display) that will be displayed in place of the "missing" data that should have been provided to the display, will be data that is already stored in the display's local frame buffer memory for a previous frame, and, in an embodiment, the data for a previous frame that was displayed in the corresponding pixel positions in the previous frame (the same pixel positions in the previous frame) that the "missing" data was intended to be displayed for.

In an embodiment, the data that is displayed in place of the "missing" data when underrun is detected comprises data that is already (and currently) stored in a latency hiding buffer (or another linear buffer) of the display controller. The Applicants have recognised in this regard that display controllers typically will have latency hiding buffers that are configured to be able to store at least one line of data (sampling point (pixel) positions) for display, such that in the event of underrun occurring, the data for the previous line of sampling positions (pixels) should still be present in the latency hiding buffer. Thus, in an embodiment, data for the previous line of sampling positions (pixels) is provided appropriately (i.e. in whole or in part) to the display for display in place of a "missing" line of data (e.g., and in an embodiment from the latency buffer).

Thus, in an embodiment, when underrun is detected, data from a (and in an embodiment the) previous line of sampling positions (pixels) in the surface being displayed is provided for display in place of the "missing" sampling positions (pixels).

In these arrangements, in an embodiment the data at the same horizontal position in a line of sampling position (pixel position) data that is already stored in the latency hiding buffer is used in place of the "missing" sampling positions (pixel positions), in an embodiment until the end of the line of sampling positions (pixel positions) is reached. This would typically be data from the immediately preceding line of sampling positions (pixel positions), as that is what will be stored in the latency hiding buffer. Thus, if there is an underrun, in an embodiment the data for the same horizontal position in the previous line is fetched in its place from the latency hiding buffer until the end of the line is reached.

In order to facilitate this operation, in an embodiment, the display controller is operable to keep track of the position in its latency hiding buffer or buffers of the start and/or end positions of the lines of sampling position (pixel position) data that are stored in the (and each respective) latency hiding buffer. This is in an embodiment done for each latency hiding buffer of the display controller.

In an embodiment, the display controller is operable to (e.g. includes processing logic operable to) determine and keep track of the (horizontal) position in the line of sampling point (pixel) positions that is currently being displayed, and correspondingly where that sampling point (pixel) position is in the previously displayed line (that is still stored in the latency hiding buffer). The display controller in an embodiment then uses this information to identify the corresponding position in the previous line of sampling point (pixel) positions that is stored in the latency hiding buffer when underrun is detected for a given sampling point (pixel) position in the current line to be displayed. In an embodiment this is done by keeping track of where the previous line of sampling point (pixel) position starts in the latency hiding buffer.

In an embodiment, when underrun is detected, and the memory system supports it, any pending memory read transactions for the line for which underrun has been detected are terminated (killed). If this is not possible, the data for the line may still be fetched from memory, e.g. into the latency hiding buffer(s) and can then be used for the next line to be displayed (or just ignored, as desired).

In an embodiment, when underrun is detected, the next line of data is not fetched from memory, with the previous line then being displayed in place of the line that has not been fetched.

The above describes the operation of the technology described herein in the event that underrun is detected when displaying an output frame. The Applicants have further recognised that it would be advantageous to detect when underrun is likely to occur, and to, in that event, take (preventative) action to try to avoid or reduce the possibility of underrun actually occurring. Thus, in an embodiment, the technology described herein also operates to (and the display processor is correspondingly configured to) attempt to reduce the likelihood of underrun occurring, e.g. and in an embodiment once a risk of underrun occurring has been detected (e.g., and in an embodiment, for a given output frame that is being displayed).

Thus, in an embodiment, the method of the technology described herein further comprises, e.g. and in an embodiment, the display controller, determining whether there is a risk that data to be provided to the display will not be fetched from memory in time for it to be provided to the display; and when it is determined that there is a risk that data to be provided to the display will not be able to be fetched from memory in time for its display, modifying the operation of the display controller and/or data processing system, e.g., and in an embodiment, so as to reduce the risk of underrun (actually) occurring.

Correspondingly, in an embodiment, the display controller is operable to determine whether there is a risk that data to be provided to the display will not be fetched from memory in time for it to be provided to the display; and to, when it is determined that there is a risk that data to be provided to the display will not be able to be fetched from memory in time for its display, modify the operation of the display controller and/or data processing system, e.g., and in an embodiment, so as to reduce the risk of underrun (actually) occurring.

The Applicants have further recognised in this regard that modifying the operation of the display controller and/or data processing system, e.g., and in an embodiment, so as to reduce the risk of underrun (actually) occurring, when a risk of underrun is identified may be new and useful in its own right, and not just in the context where data that has previously been provided to the display is used in place of any "missing" data caused by underrun.

Thus, another embodiment of the technology described herein comprises a method of operating a display controller of a data processing system, the display controller being operable to fetch data for surfaces to be displayed from memory of the data processing system into a local buffer or buffers of the display controller and to provide data from the local buffer or buffers of the display controller to a display for display, the method comprising:

the display controller, when fetching data from memory for display and providing that data to a display for display:

determining whether there is a risk that data to be provided to the display will not be fetched from memory in time for it to be provided to the display; and when it is determined that there is a risk that data to be provided to the display will not be able to be fetched from memory in time for its display, modifying the operation of the display controller and/or data processing system.

Another embodiment of the technology described herein comprises a display controller for a data processing system, the display controller comprising:

one or more local buffers;

a memory read sub-system operable to fetch data of input surfaces to be processed by the display controller from memory into the local buffer or buffers of the display controller; and one or more processing stages operable to provide data from the local buffer or buffers of the display controller to a display for display;

wherein:

the display controller is operable to, when fetching data from memory for display and providing that data to a display for display:

determine whether there is a risk that data to be provided to the display will not be fetched from memory in time for it to be provided to the display; and when it is determined that there is a risk that data to be provided to the display will not be able to be fetched from memory in time for its display, modify the operation of the display controller and/or data processing system.

As will be appreciated by those skilled in the art, these embodiments of the technology described herein can and in an embodiment do include any one or more or all of the optional features of the technology described herein, as appropriate.

For example, in an embodiment, when underrun itself is detected, in an embodiment data that has previously been provided to the display is provided to the display in place of the "missing" data. (However, it would also in this regard be possible in these embodiments of the technology described herein to instead simply display a default or background colour or otherwise respond in the event of underrun, if desired.)

In these embodiments of the technology described herein, the risk of underrun occurring (that data to be provided to the display will not be fetched from memory in time for it to be provided to the display) may again be determined in any suitable and desired manner. This may be based and determined on the same basis as is discussed above for determining when underrun has occurred (i.e. determining whether data to be provided to the display has been fetched from memory or not), such that this operation would be triggered once underrun occurs.

However, in an embodiment, a different criteria (e.g., and in an embodiment, threshold) is used to identify the situation where there is a risk of underrun occurring so as to trigger the modifying of the operation of the display controller and/or data processing system. Again, this could be done in any suitable and desired manner, but is in an embodiment based on there being a (different) threshold amount of data being present in advance in a or the local buffer of the display controller.

Thus in an embodiment, a risk of underrun is identified when a latency hiding buffer or buffers of the display controller contains less than a threshold amount of data (e.g. sampling point (pixel) positions), e.g., and in an embodiment, for a line of a surface to be displayed.

Where the display controller and its corresponding display is configured such that the display (the display panel) has its own (integrated) frame buffer memory, then underrun can be, and in an embodiment is, determined to be likely when it is determined that less than a threshold amount of data to be provided to update the frame buffer of the display panel is available. This may, e.g. in an embodiment be determined when a latency hiding buffer or buffers of the display controller contains less than a threshold amount of data.

Thus, in an embodiment a record (e.g. a count) of the amount of newly fetched data from memory that is able to be provided to the display is maintained, and when that amount of "in advance" fetched data falls below a threshold amount (greater than zero), it is determined that "underrun" is likely to occur (for the purposes of this operation of the technology described herein).

The operation of the display controller and/or data processing system can be modified in response to a determination that there is a risk of underrun occurring in any suitable and desired manner. The modification to the operation is in an embodiment so as to reduce the risk of underrun (actually) occurring. Thus, in an embodiment, the modification of the operation of the display controller and/or data processing system is so as to reduce the risk that data to be fetched from memory to be provided to the display will not be able to be fetched from memory in time for its display (e.g., and in an embodiment, as compared to the current "mode" of operation of the display controller and/or data processing system).

In one embodiment, the operation of the display controller and/or data processing system in response to a determination that there is a risk of underrun occurring comprises reducing the amount of data that is fetched from the memory for display.

The amount of data that is fetched for display can be reduced when a risk of underrun is identified in any suitable and desired manner. In an embodiment, this is done by only fetching some (but not all) of the data required for displaying a layer (a surface) to be displayed. For example, and in an embodiment, only half of the data required to display a layer may be fetched from memory, instead of fetching the entire set of data for the layer or layers in question.

Thus, in an embodiment, when a risk of underrun is detected, data for a layer or layers (a surface or surfaces) that is still to be fetched from memory is in an embodiment fetched at a reduced (lower) resolution, rather than at the full resolution of the layer or layers in question. In an embodiment this is done by reducing the vertical resolution when fetching the (rest of the) layer(s) being displayed (in an embodiment, as will be discussed further below, in combination with then upscaling the fetched data when it is displayed).

Thus, in an embodiment, the display controller is configured to fetch less data from memory for displaying subsequent lines of a surface being displayed once a risk of underrun occurring has been detected (in an embodiment, as will be discussed further below, in combination with then upscaling the fetched data when it is displayed). This will then have the effect of reducing the amount of data that is being fetched from the memory for display, thereby correspondingly reducing the likelihood of underrun (actually) occurring.

In an embodiment, when a risk of underrun occurring has been identified, data for only every other, e.g. and in an embodiment horizontal, line in a layer or layers to be fetched for display is fetched from the memory (i.e., a layer is in an embodiment fetched at a reduced resolution by fetching every other horizontal line for the layer in question).

This may be done for one or more layers (surfaces) that are to be combined to display the current output frame.

In an embodiment, the layer or layers (surface or surfaces) that this is done for is or are selected based on the effect that the layer will have on the final output that is displayed, and/or based on the amount of bandwidth (e.g. the amount of data) that will need to be fetched for the layer or layers.

In an embodiment, a layer or layers for which a reduced amount of data will be fetched from the memory for display when a risk of underrun is detected are selected based on one or more of the following criteria: whether the layer is a background surface (such that it will be less visible); whether the layer is a surface with a large horizontal resolution (such that it will require a large amount of data to be fetched for each line); whether the layer is a surface with a high number of bits per pixel (e.g. an uncompressed RGB layer); and whether the layer is a surface that is difficult to be fetched (e.g. that is to be rotated before being displayed).

The identification and selection of which layer or layers a reduced amount of data will be fetched for when a risk of underrun is detected can be performed by any suitable and desired element of the overall data processing system, for example by providing in the data processing system (e.g. in the display controller) processing circuitry (hardware) configured to perform such a selection. Additionally or alternatively, this selection of a layer or layers to fetch a reduced amount of data for could be determined by, e.g., a driver for the display controller that is executing on a host processor of the overall data processing system (with, e.g., the display controller signalling a risk of underrun to the driver when it detects that, and the driver then driving the display controller to fetch a reduced amount of data for the selected layer or layers).

It would be possible to perform reduced resolution fetches of data for only a single layer to be used for an output frame when a risk of underrun is detected (and in one embodiment that is what is done). However, it would also be possible to perform reduced resolution fetches for two or more layers to be combined to provide an output frame (and in another embodiment this is done). Where reduced resolution fetching of data for two (or more) layers is being performed, then in an embodiment for each respective pair of two layers, alternate lines are fetched for those layers, i.e. only the odd lines are used for one layer of the pair and only the even lines are used for the other layer of the pair. This will then mean that data is not being fetched from memory for both layers of the pair at the same time.

In an embodiment, when a risk of underrun is detected, the next line of data is in an embodiment not fetched from memory and instead the reduced resolution fetches start on the following line, with the previous line then being displayed in place of the line that has not been fetched.

When a risk of underrun is detected, then reduced resolution fetching of the data for an input layer or layers is in an embodiment performed at least for the remainder of the output frame that is currently being generated. It may also be performed for subsequent output frames to be generated (e.g. for a selected number of subsequent output frames), if desired (and in one embodiment this is done). Alternatively, the input layer(s) for the next output frame could be fetched at the "full" resolution, unless and until a risk of underrun is detected for that output frame.

It will be appreciated that in the above embodiments of the technology described herein, the data for one or more layers that are to be displayed will be being fetched at a lower resolution than the required resolution for display. The display controller accordingly in an embodiment operates to compensate for the fact that the data is being fetched at a lower resolution, and in an embodiment still operates to provide data to the display at the full resolution for the layer or layers in question.

This can be achieved in any suitable and desired manner. For example, the display controller could simply operate to repeat data that it has fetched for a reduced resolution layer when providing data to the display so as to provide data to the display at the required, "full" resolution. For example, the display controller could simply operate to repeat each horizontal line when providing data to the display for display, so as to ensure that a "full" resolution set of data is provided to the display for display, even though only every other horizontal line (for example) for the layer in question has been fetched from memory.

In an embodiment, the display controller is operable to appropriately upscale the reduced resolution set of data that has been fetched for a layer or layers when the risk of underrun has been identified, so as to generate a "full" resolution set of data for the layer or layers in question, which "full" resolution set of data is then provided to the display for display. Such upscaling of the fetched data for a layer or layers can be performed as desired and can use any suitable and desired scaling process (scaling algorithm). For example, in the case where the resolution of the data that is fetched is reduced by fetching every other horizontal line, then appropriate vertical scaling can be performed to upscale that reduced resolution set of data to the required resolution for display.

Such scaling is in an embodiment performed using an appropriate scaling stage (scaling circuitry) of the display controller. This will make it relatively straightforward for the display controller to upscale a reduced resolution set of data that has been fetched for a layer or layers when a risk of underrun has been identified.

Thus, in an embodiment, when a risk of underrun is identified, a layer or layers that are being displayed is fetched at a reduced resolution (in an embodiment by reducing the vertical resolution of the fetched layer or layers), with the reduced resolution fetched layer or layers then being upscaled to the desired, "full" resolution, before their data is provided to the display for display.

In an embodiment, the system, e.g. display controller, may also or instead be configured to fetch a reduced amount of data for a line that is in the process of being fetched when a risk of underrun is detected. In an embodiment the fetching of data for the current line(s) or line-part is stopped, with, e.g., the data from the previous line being re-used instead.

In the case where the display panel that the display controller is associated with has its own local frame buffer memory, such that the display panel supports partial updates, then the next update "region" is in an embodiment marked as not needing to be updated.

Similarly, for systems where the display panel supports partial updates then while it would in one embodiment be possible to reduce the amount of data that is fetched for the remainder of an output frame by fetching the data for an input layer or layers at a reduced resolution, as discussed above (and in one embodiment that is what is done), it would also be possible to reduce the amount of bandwidth that is consumed to reduce the likelihood of an underrun happening again by not updating the display for some or all of the rest of the output frame (and in an embodiment, this is what is done).

Thus, in the case where the display panel that the display controller is associated with has its own local frame buffer memory, such that the display panel supports partial updates, then in an embodiment, in response to detecting a likelihood of underrun for a frame, the operation in an embodiment comprises one of the following: not updating the rest of the line when a likelihood of underrun has been detected; not updating a given, in an embodiment selected, number of the following (next) lines of the display when a likelihood of underrun has been detected; and/or not updating the rest of the output frame when a likelihood of underrun has been detected.

For such display panels, the updating or not may be performed, e.g., for full width lines, half-width lines, etc., depending on what form of updating the display controller and display panel supports.

The operation of the data processing system and/or data processor can be modified in other ways when it is determined that there is a risk of underrun occurring, if desired. This may be as well as (in addition to) or instead of (and in an embodiment is as well as) reducing the amount of data that is fetched from the memory for display when a risk of underrun is identified.

In one embodiment (where the display controller and/or data processing system supports this) the clock frequency of a component or components of the system is increased in the event that a risk of underrun is detected. This may be done for any desired and suitable component(s), such as, and in an embodiment, a component or components that relate to the memory operation (system) and/or the fetching of data for display. In an embodiment, one or more of the display processor, interconnect, memory system, memory controller and memory (e.g. DDR-SDRAM) frequency is increased in the event that a risk of underrun is detected. This could then allow the required data to be fetched more quickly from memory, thereby potentially reducing the risk of underrun actually occurring.

The usefulness and possibility of such operation may depend upon the overall data processing system design and configuration. For example, if the memory controller runs at higher frequency than the interconnect that the display controller is connected to, then it may be relatively straightforward to increase the memory controller frequency so as to allow data to be fetched more rapidly (e.g., in comparison to systems in which the display controller runs at the memory controller and memory frequency).

In an embodiment, the modification of the display controller and/or data processing system operation when a risk of underrun is identified comprises also or instead (and in an embodiment also) terminating pending memory transactions (for data to be displayed); and/or stopping the generation of such memory transactions.

Thus, in an embodiment, the system is operable to perform plural different operations to modify the operation of the display controller and/or data processing system in the event that a risk of underrun is identified. Correspondingly, in an embodiment, the system is operable to select one or more of those operation modifications to use when a risk of underrun is identified.

While it would be possible simply to have a single threshold setting that is used to identify a risk of underrun, in an embodiment, plural different thresholds (e.g. of available data in the local, e.g. latency hiding, buffer or buffers of the data processing system and/or display controller) can be, and are in an embodiment, set and used to identify a risk of underrun occurring, and, correspondingly, to trigger the modification of the operation of the display controller and/or data processing system accordingly.

Thus, in an embodiment, there are plural different "underrun detection" threshold levels, with each such level in an embodiment triggering a given (and in an embodiment different) modification of the operation of the display controller and/or data processing system.

In an embodiment, there is a first threshold level that is triggered when the amount of data in the local buffer (e.g. latency hiding buffer) falls below a first level, in response to which the operation of the display controller and/or data processing system is modified by increasing the memory system and memory operation frequency, and/or by fetching a reduced amount of data (and, in an embodiment, upscaling the fetched data).

There is then in an embodiment a lower threshold amount of data (indicating that there is less "advance" data in the buffer than for the first threshold level), in response to which the generation of data requests (memory transactions) is stopped for data that will be likely to be returned from memory too late, and/or, for panels that support partial update, the next update region is marked as not requiring an update.

There is in an embodiment also a third threshold level for an even lower amount of (or zero) data, which is considered to be indicative of underrun actually occurring, in response to which data that has previously been provided to the display is provided to the display in place of the "missing" data.

As discussed above, in operation of the technology described herein, the display controller will fetch data for input surface(s) to be displayed, and then process those input surface(s) to provide an output surface (frame) for display.

To facilitate this, the display controller in an embodiment comprises a memory read sub-system operable to read data of input surfaces to be processed by the display controller. The memory read subsystem of the display controller can function as desired and include any suitable and desired elements and components of such subsystems, such as, for example, and in an embodiment, appropriate local latency hiding buffers, a Direct Memory Access (DMA) read controller, etc.

Each input surface fetched by the display controller (that is used as an input layer by the display controller) may be any suitable and desired such surface, such as, and in an embodiment, an image, e.g. frame, for display.

The input surface or surfaces can be generated as desired. For example the one or more input surfaces may be generated by being appropriately rendered and stored into a memory (e.g. frame buffer) by a graphics processor. Additionally or alternatively, one or more input surfaces may be generated by being appropriately decoded and stored into a memory (e.g. frame buffer) by a video codec. Additionally or alternatively, one or more input surfaces may be generated by a digital camera image signal processor (ISP), or other image processor. The input surface or surfaces may be, e.g., for a game, a demo, a graphical user interface (GUI), a GUI with video data (e.g. a video frame with graphics "play back" and "pause" icons), etc.

The input surface or surfaces (layer or layers) may be used to provide an output surface (frame) for display in any suitable and desired manner. There may only be one input surface that is read and processed to generate a given output surface, but in an embodiment there are plural (two or more) input surfaces that are read and processed to generate the output surface. In embodiments, the output surface is composited from plural input surfaces.

The display controller may be operable to process an input surface or surfaces to generate an output surface in any desired and suitable manner. In an embodiment it includes a processing stage that does this. Thus, in an embodiment, the display controller comprises a processing stage operable to process one or more read (fetched) input surfaces to generate an output surface.

It will be appreciated in this regard that providing data from the local buffer or buffers to a display for display may accordingly, and in an embodiment does, comprise processing the data that is fetched into the local buffer(s) of the display controller before providing that data to a display for display.

In an embodiment, the display controller (e.g. processing stage) is operable to compose (two or more) input surfaces to generate a composited output surface.

The display controller (e.g. processing stage) may also or instead, and in an embodiment also, be operable to decode (e.g. decompress) an input surface, e.g. to generate one or more decoded (e.g. decompressed) input surfaces, and/or to rotate an input surface, e.g. to generate one or more rotated input surfaces.

In an embodiment, the display controller (e.g. processing stage) is also or instead, and in an embodiment also, operable to scale (e.g. upscale and/or downscale) one or more surfaces, e.g. to generate one or more scaled surfaces. The "scaled" surface(s) may be an input surface or surfaces and/or the output surface.

The display controller (e.g. processing stage) may further comprise one or more layer pipelines operable to perform one or more processing operations on one or more input surfaces, as appropriate, e.g. before providing the one or more processed input surfaces to a scaling stage and/or composition stage, or otherwise. Where the display controller can handle plural input layers, there may be plural layer pipelines, such as a video layer pipeline or pipelines, a graphics layer pipeline, etc. These layer pipelines may be operable, for example, to provide pixel processing functions such as pixel unpacking, colour conversion, (inverse) gamma correction, and the like.

The display controller may also include a post-processing pipeline operable to perform one or more processing operations on one or more surfaces, e.g. to generate a post-processed surface. This post-processing may comprise, for example, colour conversion, dithering, and/or gamma correction.

Correspondingly, the processing of the input surface(s) to generate an output surface in an embodiment comprises one or more of and in an embodiment all of: decoding, rotation, composition, and scaling. The output surface may, e.g., be subjected to post-processing.

The display controller may correspondingly provide a processed input surface or surfaces for display in any suitable and desired manner. In an embodiment it comprises an output stage for this purpose. Thus, in an embodiment, the display controller comprises an output stage operable to provide an output surface for display to a display.

The output stage of the display controller of the technology described herein may be any suitable output stage operable to provide an output surface for display to a display, e.g. to cause the output surface for display to be displayed on the display. The output stage in an embodiment comprises a display processing pipeline that performs the desired display processing operations on the output surface to be displayed. The output stage in an embodiment comprises appropriate timing control functionality (e.g. it is configured to send pixel data to the display with appropriate horizontal and vertical blanking periods), for the display.

The display that the display controller of the technology described herein is used with may be any suitable and desired display, such as for example, a screen. It may comprise the overall data processing system's (device's) local display (screen) and/or an external display. There may be more than one display output, if desired.

The various stages of the display controller may be implemented as desired, e.g. in the form of one or more fixed-function units (hardware) (i.e. that is dedicated to one or more functions that cannot be changed), or as one or more programmable processing stages, e.g. by means of programmable circuitry that can be programmed to perform the desired operation. There may be both fixed function and programmable stages.

One or more of the various stages of the technology described herein may be provided as separate circuit elements to one another. Additionally or alternatively, some or all of the stages may be at least partially formed of shared circuitry.

It would also be possible for the display controller to comprise, e.g., two display processing cores, each configured in the manner discussed above, if desired.

In an embodiment, the display controller of the technology described herein forms part of a data processing system. Thus, another embodiment of the technology described herein comprises a data processing system comprising a display controller that is in accordance with the technology described herein.

The data processing system may and in an embodiment does also comprise one or more of, and in an embodiment all of: a central processing unit, a graphics processing unit, a video processor (codec), a system bus, and a memory controller.

The display controller and/or data processing system may be, and in an embodiment is, configured to communicate with one or more of (and the technology described herein also extends to an arrangement comprising one or more of): an external memory (e.g. via the memory controller), one or more local displays, and/or one or more external displays. The external memory in an embodiment comprises a main memory (e.g. that is shared with the central processing unit (CPU)) of the overall data processing system.

Thus, in some embodiments, the display controller and/or data processing system comprises, and/or is in communication with, one or more memories and/or memory devices that store the data described herein, and/or store software for performing the processes described herein. The display controller and/or data processing system may also be in communication with and/or comprise a host microprocessor, and/or with and/or comprise a display for displaying images based on the data generated by the display controller.

Correspondingly, a further embodiment of the technology described herein comprises a data processing system comprising:

a main memory;

a display;

one or more processing units operable to generate input surfaces for display and to store the input surfaces in the main memory; and a display controller, the display controller comprising:

one or more local buffers;

a memory read sub-system operable to fetch data of input surfaces to be processed by the display controller from memory into the local buffer or buffers of the display controller;

a processing stage operable to process one or more fetched input surfaces to generate an output surface; and an output stage operable to provide an output surface for display to a display;

wherein:

the display controller is operable to, when fetching data from memory for display and providing that data to a display for display:

determine whether data to be provided to the display has been fetched into a local buffer of the display controller or not;

and when it is determined that data to be provided to the display has not been fetched into a local buffer of the display controller, provide to the display in place of the data that has not been fetched into a local buffer of the display controller, data that has previously been fetched into the local buffer of the display controller.

Correspondingly, a further embodiment of the technology described herein comprises a data processing system comprising:

a main memory;

a display;

one or more processing units operable to generate input surfaces for display and to store the input surfaces in the main memory; and a display controller, the display controller comprising:

one or more local buffers;

a memory read sub-system operable to fetch data of input surfaces to be processed by the display controller from memory into the local buffer or buffers of the display controller;

a processing stage operable to process one or more fetched input surfaces to generate an output surface; and an output stage operable to provide an output surface for display to a display;

wherein:

the display controller is operable to, when fetching data from memory for display and providing that data to a display for display:

determine whether there is a risk that data to be provided to the display will not be fetched from memory in time for it to be provided to the display; and when it is determined that there is a risk that data to be provided to the display will not be able to be fetched from memory in time for its display, modifying the operation of the display controller and/or data processing system, e.g., and in an embodiment, so as to reduce the risk of underrun (actually) occurring.

As will be appreciated by those skilled in the art, these embodiments of the technology described herein can and in an embodiment do include one or more, and in an embodiment all, of the optional features of the technology described herein.

In use of the display controller and data processing system of the technology described herein, one or more input surfaces will be generated, e.g., and in an embodiment, by a GPU, CPU and/or video codec, etc. and stored in memory. Those input surfaces will then be processed by the display controller to provide an output surface for display.

As part of this processing the display controller will determine if underrun has occurred or is at risk of occurring, and then operate accordingly. The "underrun" monitoring and operation in the manner of the technology described herein may be carried out for a single input layer or plural input layers. In an embodiment it is carried out for each input layer that the display controller is operable to (and operating to) handle.

Correspondingly, the operation in the manner of the technology described herein is in an embodiment repeated for plural output frames to be displayed, e.g., and in an embodiment, for a sequence of frames to be displayed.

The technology described herein can be implemented in any suitable system, such as a suitably configured microprocessor based system. In an embodiment, the technology described herein is implemented in a computer and/or micro-processor based system.

The various functions of the technology described herein can be carried out in any desired and suitable manner. For example, the functions of the technology described herein can be implemented in hardware or software, as desired. Thus, for example, unless otherwise indicated, the various functional elements, stages, and "means" of the technology described herein may comprise a suitable processor or processors, controller or controllers, functional units, circuitry, processing logic, microprocessor arrangements, etc., that are operable to perform the various functions, etc., such as appropriately dedicated hardware elements and/or programmable hardware elements that can be programmed to operate in the desired manner.

It should also be noted here that, as will be appreciated by those skilled in the art, the various functions, etc., of the technology described herein may be duplicated and/or carried out in parallel on a given processor. Equally, the various processing stages may share processing circuitry, etc., if desired.

Furthermore, any one or more or all of the processing stages of the technology described herein may be embodied as processing stage circuitry, e.g., in the form of one or more fixed-function units (hardware) (processing circuitry), and/or in the form of programmable processing circuitry that can be programmed to perform the desired operation. Equally, any one or more of the processing stages and processing stage circuitry of the technology described herein may be provided as a separate circuit element to any one or more of the other processing stages or processing stage circuitry, and/or any one or more or all of the processing stages and processing stage circuitry may be at least partially formed of shared processing circuitry.

Subject to any hardware operable to carry out the specific functions discussed above, the display controller can otherwise include any one or more or all of the usual functional units, etc., that display controllers include.

It will also be appreciated by those skilled in the art that all of the described embodiments of the technology described herein can, and in an embodiment do, include, as appropriate, any one or more or all of the features described herein.

The methods in accordance with the technology described herein may be implemented at least partially using software e.g. computer programs. Thus, further embodiments of the technology described herein comprise computer software specifically adapted to carry out the methods herein described when installed on a data processor, a computer program element comprising computer software code portions for performing the methods herein described when the program element is run on a data processor, and a computer program comprising code adapted to perform all the steps of a method or of the methods herein described when the program is run on a data processing system. The data processor may be a microprocessor system, a programmable FPGA (field programmable gate array), etc.

The technology described herein also extends to a computer software carrier comprising such software which when used to operate a display controller, or microprocessor system comprising a data processor causes in conjunction with said data processor said controller or system to carry out the steps of the methods of the technology described herein. Such a computer software carrier could be a physical storage medium such as a ROM chip, CD ROM, RAM, flash memory, or disk, or could be a signal such as an electronic signal over wires, an optical signal or a radio signal such as to a satellite or the like.

It will further be appreciated that not all steps of the methods of the technology described herein need be carried out by computer software and thus further embodiments of the technology described herein comprise computer software and such software installed on a computer software carrier for carrying out at least one of the steps of the methods set out herein.

The technology described herein may accordingly suitably be embodied as a computer program product for use with a computer system. Such an implementation may comprise a series of computer readable instructions either fixed on a tangible, non-transitory medium, such as a computer readable medium, for example, diskette, CD-ROM, ROM, RAM, flash memory, or hard disk. It could also comprise a series of computer readable instructions transmittable to a computer system, via a modem or other interface device, over either a tangible medium, including but not limited to optical or analogue communications lines, or intangibly using wireless techniques, including but not limited to microwave, infrared or other transmission techniques. The series of computer readable instructions embodies all or part of the functionality previously described herein.

Those skilled in the art will appreciate that such computer readable instructions can be written in a number of programming languages for use with many computer architectures or operating systems. Further, such instructions may be stored using any memory technology, present or future, including but not limited to, semiconductor, magnetic, or optical, or transmitted using any communications technology, present or future, including but not limited to optical, infrared, or microwave. It is contemplated that such a computer program product may be distributed as a removable medium with accompanying printed or electronic documentation, for example, shrink-wrapped software, preloaded with a computer system, for example, on a system ROM or fixed disk, or distributed from a server or electronic bulletin board over a network, for example, the Internet or World Wide Web.

A number of embodiments of the technology described herein will now be described.

Figure 3:
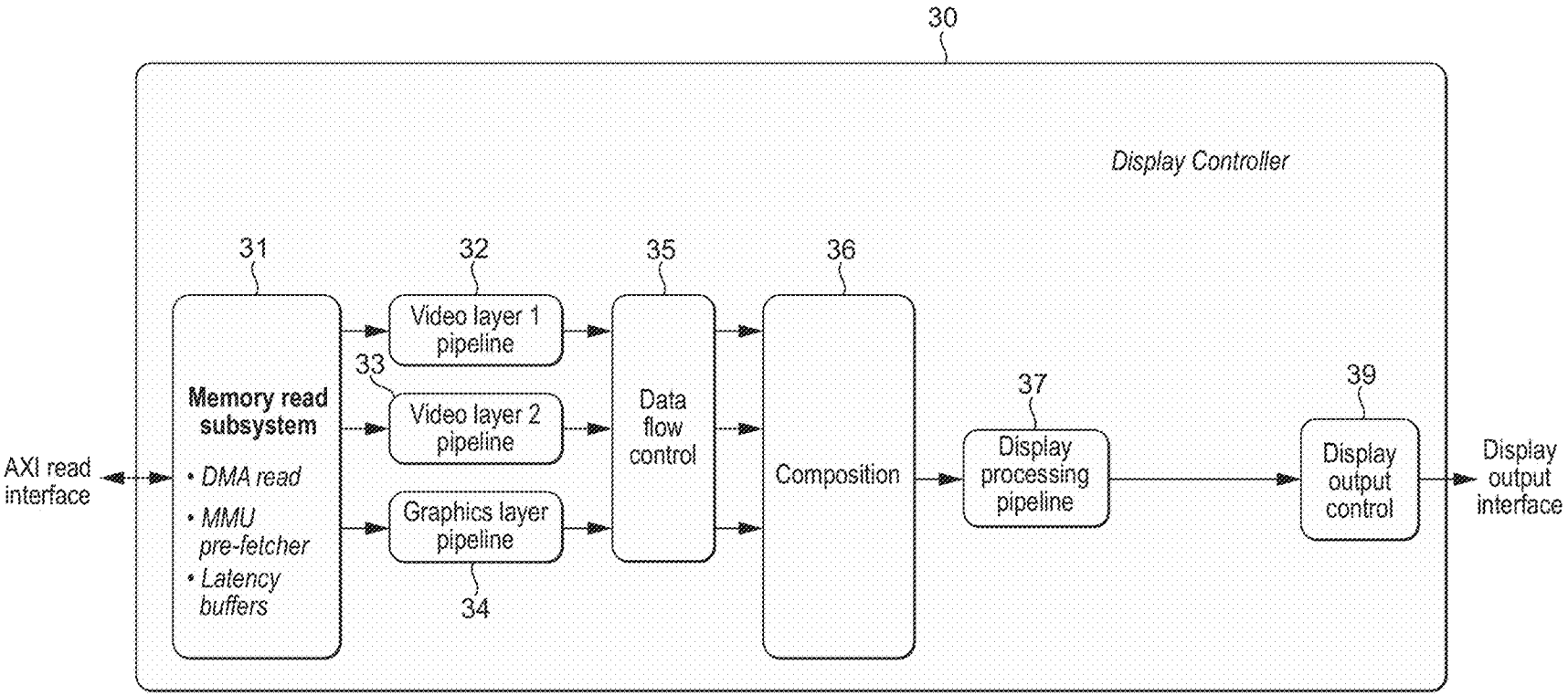
FIG. 3 shows schematically a display controller that can be operated in accordance with an embodiment of the technology described herein.

FIG. 3 shows schematically a display controller 30 in accordance with an embodiment of the technology described herein. In FIG. 3, the boxes represent functional units of the display controller, while the arrowed lines represent connections between the various functional units. The display controller 30 may be used in a data processing system, e.g. of the form shown in FIG. 1.

As shown in FIG. 3, the display controller 30 comprises a memory read subsystem 31 that includes, inter alia, a read controller in the form of a Direct Memory Access (DMA) read controller. The read controller is configured to read one or more input surfaces from one or more frame buffers in a main memory 3 (not shown in FIG. 3) via a memory bus.

The memory read subsystem 31 further comprises one or more real-time FIFO (first-in-first-out) modules which are used to buffer locally the one or more input surfaces as they are read from memory, e.g. for latency hiding purposes.

In this embodiment, the memory read subsystem 31 is configured to provide (read) up to three different input surfaces for use as input layers which are to be used to generate a composited output frame. The three input layers may comprise one or more video layers, e.g. generated by a video processor (codec) 1, and one or more graphics layers, e.g. graphics windows generated by a graphics processing unit (GPU) 2, and so on. Hence, FIG. 3 shows the display controller 30 comprising three layer pipelines 32, 33, 34 which will each receive data from an input surface to be used as a display layer. Any or all of the input surfaces received by the layer pipelines may have been subjected to decoding by a decoder and/or rotation by a rotation unit, if desired.

Each layer pipeline 32, 33, 34 performs appropriate operations on the received surfaces, such as pixel unpacking from the received data words, colour (e.g. YUV to RGB) conversion, and inverse gamma or inverse sRGB correction.

Although the embodiment of FIG. 3 illustrates the use of three layer pipelines (and therefore up to three input layers), it will be appreciated that any number of layer pipelines may be provided and used in the technology described herein, depending on the application in question (and also depending on any silicon area constraints, etc.).

The display controller 30 further comprises a composition unit 36 that can receive inputs from the layer pipelines 32, 33, 34 and operates to compose the received input layers to generate a composited output surface, e.g. by appropriate alpha blending operations, etc.

The layer processing pipelines 32, 33, 34 and the composition unit 36 together act as a processing stage of the display controller 30 that takes data of input surfaces read by the memory read subsystem 31 and produces from that data an output surface, e.g. for display.

The composited output frames from the composition unit 36 are onwardly transmitted to a display processing (post-processing) pipeline 37 for display.

The display pipeline 37 is configured to selectively carry out any desired processing operation(s) on the composited output surface (frame), and to then transmit the (processed) composited output frame for appropriate display on the associated display.

The display processing pipeline 37 may, for example, comprise a colour conversion stage operable to apply a colour conversion to the composited output frame, a dithering stage operable to apply dithering to the composited output frame, and/or a gamma correction stage operable to carry out gamma correction on the composited output frame.

The display processing pipeline 37 also comprises appropriate display timing functionality. Thus, the display processing pipeline 37 is configured to send pixel data to the display outputs 39 with e.g. appropriate horizontal and vertical blanking periods. For example, horizontal and vertical synchronization pulses (HSYNC, VSYNC) may be generated together with a DATAEN signal which is asserted in non-blanking periods. In blanking periods DATAEN is de-asserted and no data is sent to the display (there are 4 blanking periods: horizontal front porch—before the HSYNC pulse, horizontal back porch—after the HSYNC pulse, vertical front porch—before the VSYNC pulse, and vertical back porch—after the VSYNC pulse).

It would also be possible to use other display timing and data (pixel) packing schemes, such as MIPI DPI, HDMI, Display Port, etc., if desired. The display output 39 may, e.g. interface with a local display of the data processing system (e.g. of the mobile device, smart phone, tablet, etc., that the data processing system is part of).

The display processing pipeline 37 and display output control interfaces 39 accordingly act as an output stage for the display controller 30 for providing output surfaces for display to a display.

The display controller 30 also includes a data flow control module 35 that is operable to direct the data flows through the display controller, i.e. to provide the input layers, composited output surfaces, etc., to the appropriate units for processing as shown in FIG. 3. In the present embodiment, the data flow controller 35 operates under appropriate software control, e.g., and in an embodiment, from a driver for the display controller that is running on a host processor (e.g. the CPU 7) of the overall data processing system that the display controller 30 is part of. The driver may generate appropriate commands for the data flow controller 35 and program control registers of the display controller 30 in response to, e.g., commands and data for display processing received from an application running on the host processor.

Other arrangements in this regard, would, of course, be possible.

As discussed above, when the display controller 30 is to provide an output frame for display, it will read in data of one or more input surfaces that have been generated, e.g., by video codec 1 and/or GPU 2, and which are stored in respective frame buffers in the main memory 3, to act as input layers in its output surface generation process, process that input surface data (e.g. by compositing it into an output frame) and provide the (composited) output frame to the display for display via the display processing pipeline 37.

A number of embodiments of the technology described herein will now be described with reference to the operation of a display processing system and a display controller that operates to display output frames to be displayed, by fetching respective data for lines of pixel positions in a layer to be displayed into a linear latency hiding buffer, and then provides the data from the local linear latency hiding buffer to a display for display.

Figure 4:
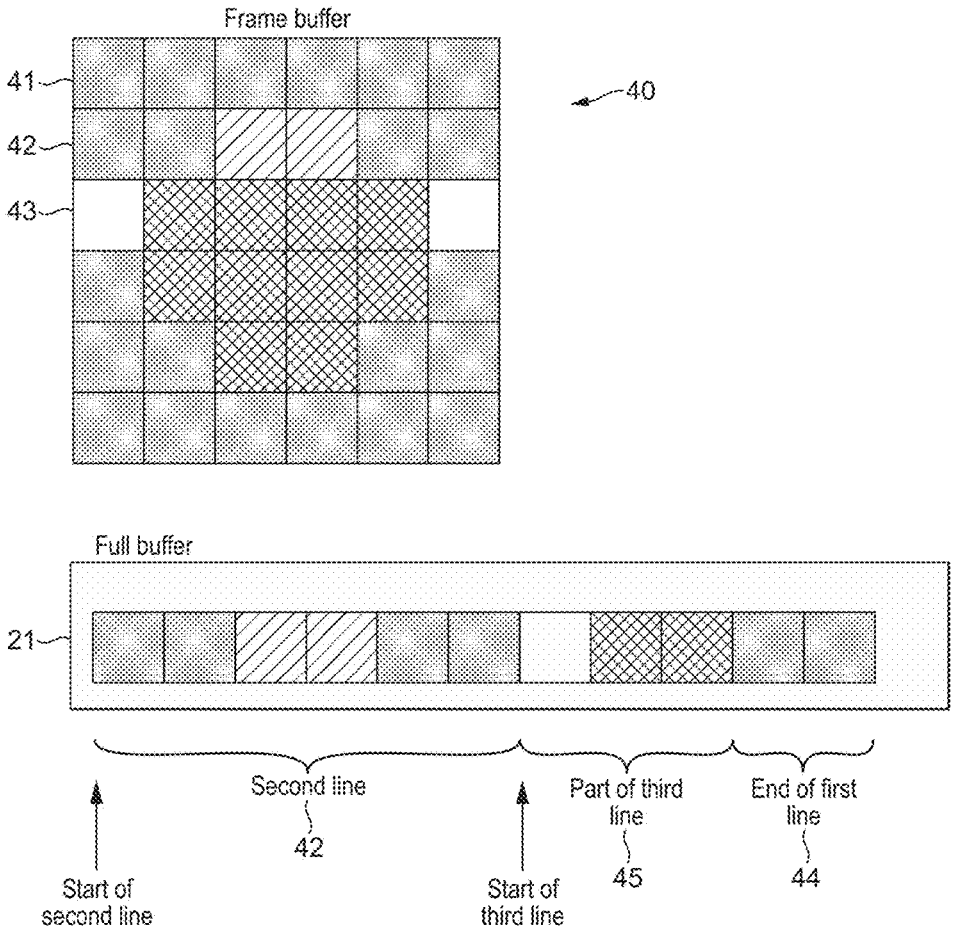
FIG. 4 shows schematically the fetching of data in an embodiment of the technology described herein.

FIG. 4 illustrates this process for an example input layer (surface) 40 to be displayed that is stored in a frame buffer in the main memory 3 of the overall data processing system.

As shown in FIG. 4, data for successive lines of sampling (pixel) positions 41, 42, 43, etc., from the layer 40 are loaded into the latency hiding linear buffer 21 of the display processing pipeline of the display controller 30 that is to process the layer 40 for display.

As shown in FIG. 4, it is assumed in this regard that the latency hiding buffer 21 for the layer pipeline in question can store data for more than a single line from the input layer 40. Thus FIG. 4 shows, as an example, the situation where the first line 41 is being displayed on the display and so only the end 44 of the first line remains in the latency hiding buffer 21, with the full second line 42 of the input layer 40 having been loaded into the latency hiding buffer 21, and the start 45 of the third line 43 of the input layer 40 also having been loaded into the latency hiding buffer 21. In this example it is assumed that all of the data has been able to be fetched into the latency hiding buffer 21, such that no underrun has occurred.

As discussed above, the technology described herein, and accordingly the present embodiments, relates to the situation where there may be "underrun" in fetching data into the latency hiding buffer for a layer to be displayed of the display controller. In this case therefore, unlike in the situation shown in FIG. 4, the full set of data for a line of the input layer will not be present in the latency hiding buffer when the display processing pipeline of the display controller needs the data for that line of the input layer.

In this case, and in accordance with the technology described herein, the display controller 30 operates to display in place of the data that is missing for the line of the input layer, data for the previous line of the input layer that will be present in the latency hiding buffer 21. (As can be seen, for example, from FIG. 4, if it was not possible to fetch all of the data for the third line 43 of the input layer into the latency hiding buffer 21, there would still be the data for the second line 42 of the input layer 40 present in the latency hiding buffer 21. The display controller 30 can therefore use that second line data in place of the missing third line of data.)

Figure 5:
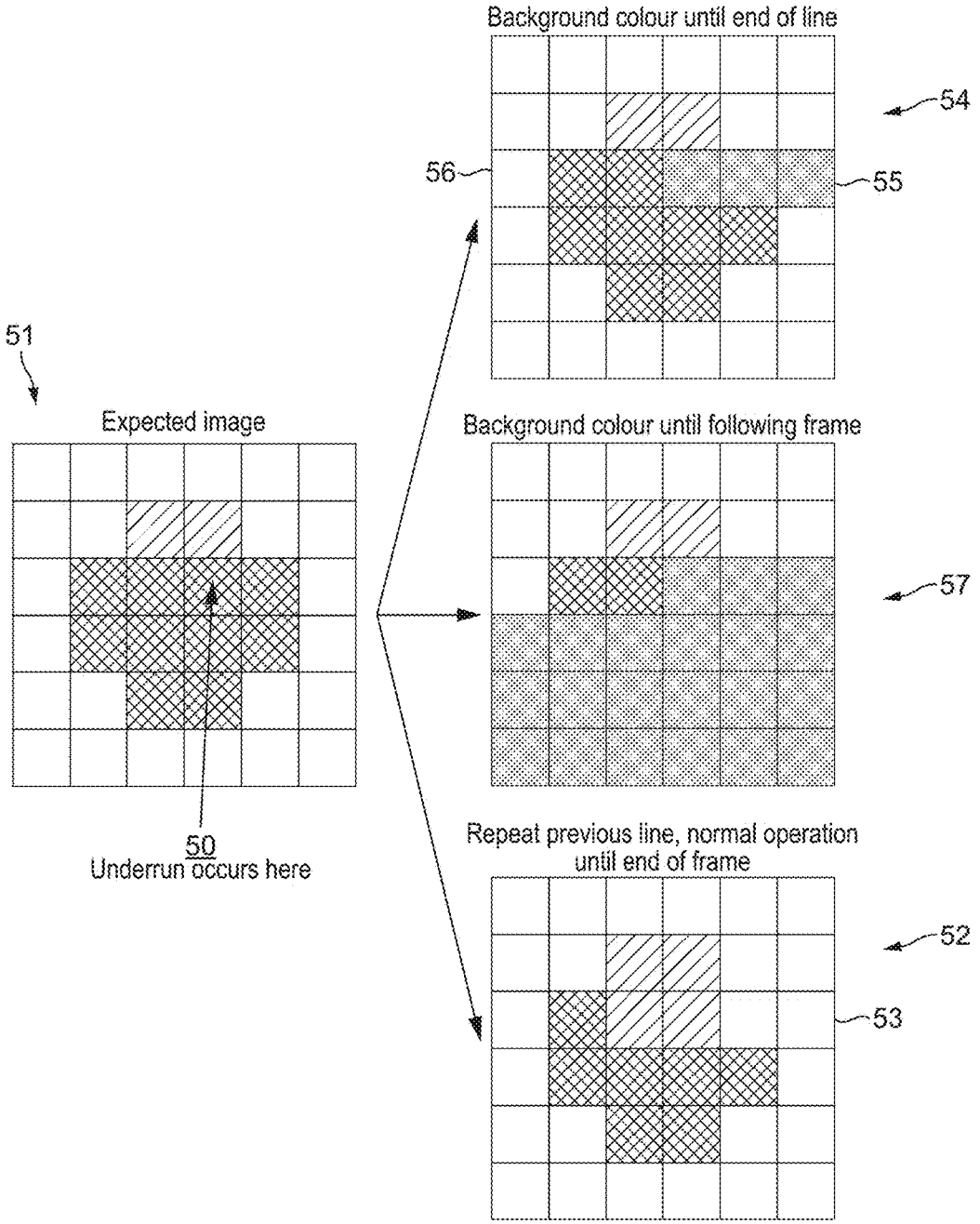
FIG. 5 illustrates an embodiment of the technology described herein.

FIG. 5 illustrates this operation and shows schematically what happens in an embodiment of the technology described herein when underrun occurs at a position 50 when fetching data of an input layer 51 from a frame buffer in main memory. In this case, as shown for the bottom frame 52 in FIG. 5, in the present embodiment, the display controller 30 operates to repeat data from the previous line in the line 53 where the underrun occurred. The remaining lines of the input layer are then fetched and displayed normally in this example.

FIG. 5 also shows for comparison purposes only two alternative arrangements to the technology described herein. In the first such arrangement 54, a background colour 55 is displayed until the end of the line 56 where underrun occurs. In a second such arrangement 57, a background colour is displayed for the rest of the frame once underrun has occurred. It can be seen from a comparison of the arrangement of the present embodiment with these two examples, that the present embodiment provides a more visually acceptable operation in the event of underrun occurring.

Figure 6:
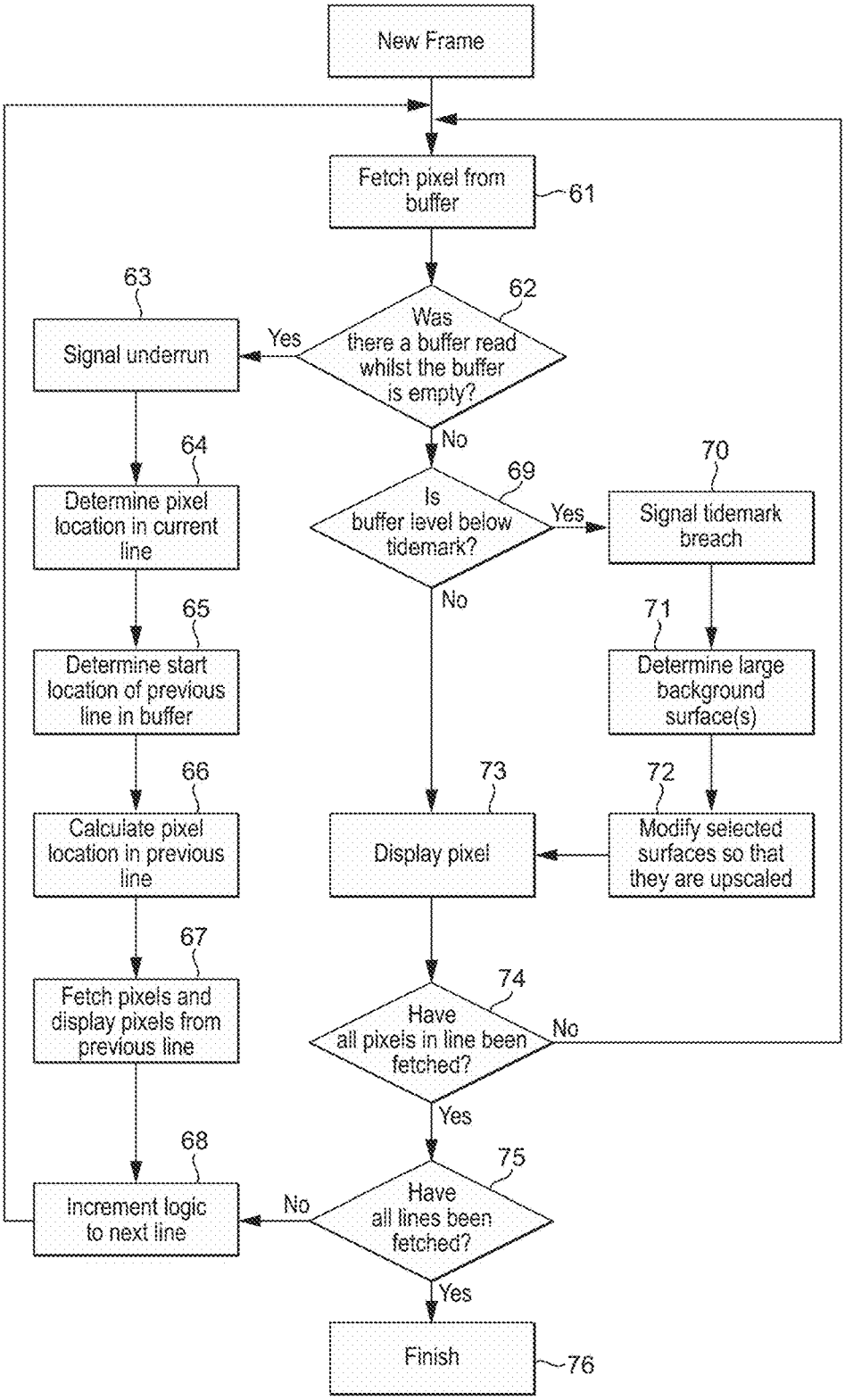
FIG. 6 is a flowchart showing the operation of a display controller in an embodiment of the technology described herein.

FIG. 6 is a flowchart showing the operation of the display controller 30 in this embodiment of the technology described herein. FIG. 6 shows the operation when a new output frame is to be processed and provided for display by the display controller and shows the display controller operation for a respective input layer that is to processed to provide the output frame. This operation is performed, in an embodiment in parallel, for each input layer that is being processed to provide the output frame.

The first step in the process is to fetch pixel data for the input layer from the latency hiding buffer for the next pixel to be processed for display (step 61).

It is then determined at this stage if that pixel data was present in the latency hiding buffer (step 62).

If the pixel data was not present in the latency hiding buffer, then that is indicative of underrun having occurred, and so the display controller identifies in that event that underrun has occurred (step 63). In response to this, the display controller determines the pixel location in the current line (i.e. the point at which the underrun has occurred) (step 64), then identifies the start location of the pixel data for the previous line in the input layer in the latency hiding buffer (step 65). To facilitate this operation, the display controller keeps track of the position in the latency hiding buffer of the start and end of each line of an input layer that is present in the latency hiding buffer. (For a 16 kB latency hiding FIFO, with 128-bit data words, for example, this would require two 10-bit data words.)

Other line buffers in the display controller could be used for this, if desired.

The display controller then calculates the position in the latency hiding buffer of the data for the corresponding horizontal pixel location in the previous line of the input layer (i.e. for the pixel location that has the same horizontal position in the previous (horizontal) line of the input layer) (step 66) and then fetches the pixel data for that pixel location and the subsequent pixel locations for the previous line and displays that pixel data for the previous line in place of the (missing) data for those pixel locations in the current line (step 67). The process is then incremented to the next line in the input layer (step 68) and repeated.

In this embodiment, as shown in FIG. 6, the display controller 30 also operates to identify when there is a risk of underrun occurring, and to, in response to such identification, then take steps to try to avoid the occurrence of underrun.

In this embodiment, this is done by identifying when the amount of pre-fetched data in the latency hiding buffer for an input layer falls below a threshold amount (falls below an underrun mitigation tide mark), and then, in response thereto, operating to fetch subsequent data for an input layer or layers at a reduced resolution, so as to reduce the bandwidth burden on fetching the data from memory for the input layer or layers, so as to reduce the likelihood of that underrun will occur.

In particular, in the situation where a risk of underrun occurring has been identified, one or more input layers to be fetched at a lower resolution are identified. The data for those input layers is then fetched at a lower resolution by only fetching every other horizontal line for the selected layer or layers. Such skipping of the fetching of horizontal lines for an input layer can be performed, e.g., by doubling the horizontal offset address and adding the horizontal width of the line.

Correspondingly to allow for the fact that only every other horizontal line has been fetched for an input layer in this situation, the data that is fetched for such input layers is correspondingly upscaled by the display controller (using, e.g., its scaling circuitry (stage)) to provide a "full" resolution version of the input layer that can then be provided for display.

This operation is implemented in the embodiment illustrated in FIG. 6 as follows.

Firstly, if at step 62 it is determined that underrun has not yet occurred, it is then checked whether the data still to be used in the latency hiding buffer has fallen below a threshold, underrun mitigation tide mark amount (step 69).

Figure 7:
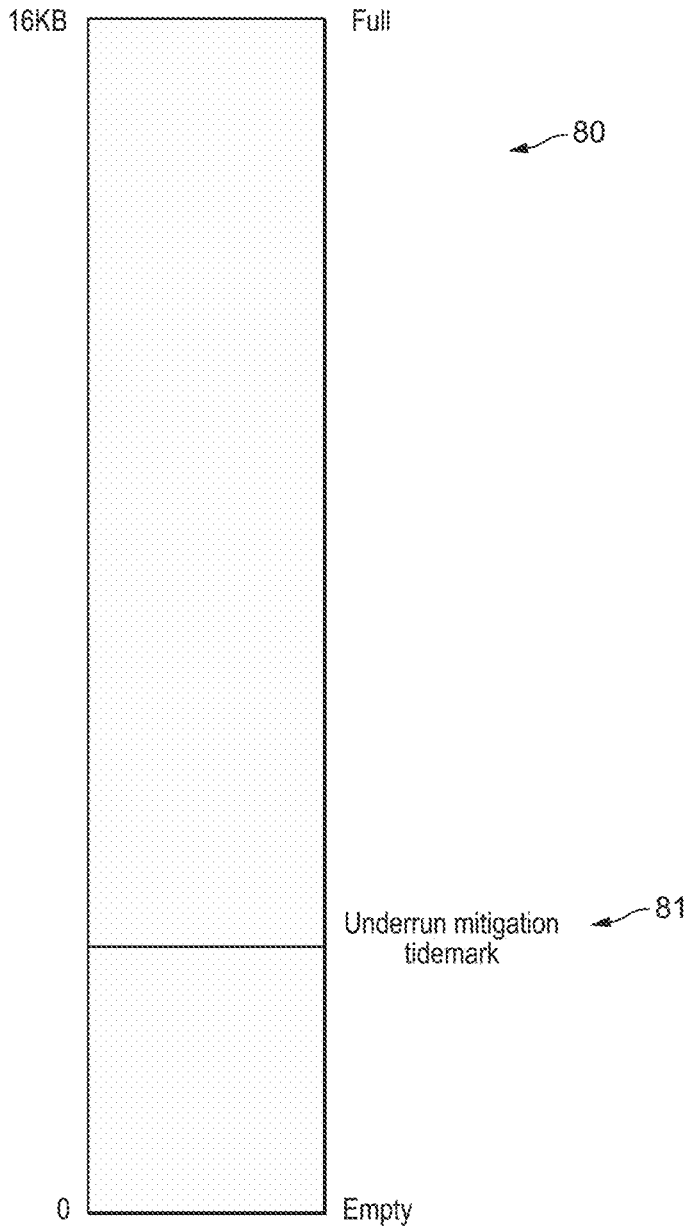
FIG. 7 shows schematically the tracking of data in a buffer in an embodiment of the technology described herein.

FIG. 7 illustrates this, and shows an example latency hiding buffer 80 with a threshold underrun mitigation tide mark amount 81 that is used as an indication of when underrun is likely to occur.

If at step 69 it is determined that the buffer level has fallen below the underrun mitigation tide mark amount, then that event is signalled, e.g., to the driver for the display controller operating on the host processor (step 70).

In response to identifying that underrun is likely to occur, the system (e.g. the driver for the display controller) then operates to identify an input layer or layers to be fetched at a reduced resolution so as to reduce the likelihood that underrun will occur (step 71). This decision could also, e.g. be performed, e.g. in hardware in, the display controller if desired.

In this embodiment it is assumed that large background surfaces are identified and selected as surfaces that should be fetched at a lower resolution when the likelihood of underrun is identified. However, other surfaces could also or instead be selected, such as surfaces with a large horizontal resolution, surfaces with a high number of bits per pixel (e.g. uncompressed RGB layers), and/or surfaces that are rotated. It is also not necessary to select background surfaces for this purpose (although that may be performed in some embodiments, as background surfaces will be less visible in the final output).

Once the selected surfaces have been identified, they are then fetched at a lower resolution by, in this embodiment, fetching every other horizontal line, with the so-fetched data then being upscaled to provide "full" resolution data for the layer (surface) in question (step 72).

The upscaling of the data fetched at a lower resolution to provide "full" resolution data for the layer (surface) in question can be performed at any suitable and desired point in the display processing sequence (pipeline), e.g., and in an embodiment, dependent on the location of the scalar (scaling circuitry) and latency buffer in the display controller processing pipeline. Typically, the scaling stage will be after the latency buffer, and so the data will be loaded (fetched) in to the latency buffer at a lower resolution, and then up-scaled once it has been fetched from the latency buffer for display.

As shown in FIG. 6, once the relevant data has been fetched into the latency hiding buffer, the pixel data for the pixel position in question can be displayed (step 73).

As shown in FIG. 6, the pixel data is also displayed in step 73 if it is determined at step 69 that the underrun mitigation tide mark has not been breached (i.e. such that a risk of underrun has not been identified (in which case the display of the pixel data for the line can proceed in the normal fashion)).

It is then determined in step 74 whether the data for all the pixels of the line currently being displayed have been fetched. If not, the process returns to step 61 to fetch the pixel data for the next pixel position.

Once all the pixels in a given line to be displayed have been fetched, it is then determined whether all the lines for the input layer to be displayed have been fetched (step 75). If not, the process proceeds to increment to the next line for the input layer to be displayed (step 68) and the process is repeated for that line. Once all the lines have been fetched and provided for display, the current input layer is completed (step 76).

The process may then be repeated for the next output frame to be displayed, and so on.

Figure 8:
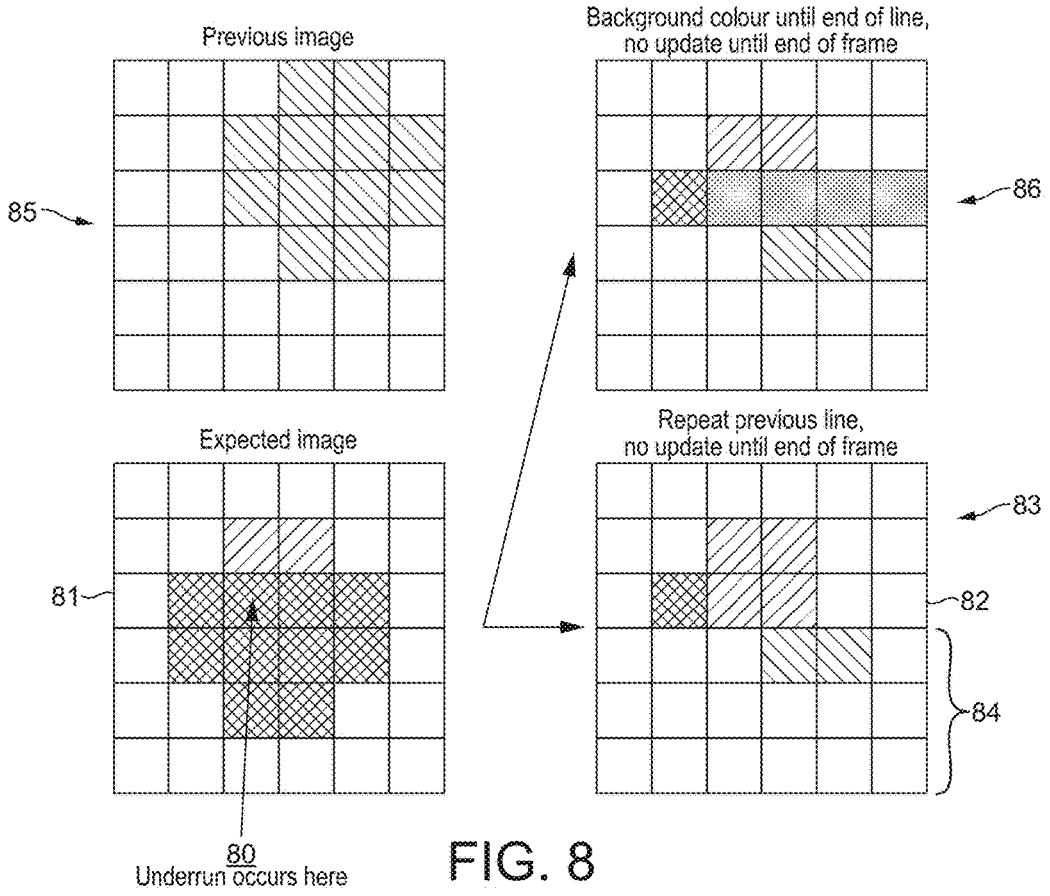
FIGS. 8 and 9 illustrate other embodiments of the technology described herein.
Figure 9:
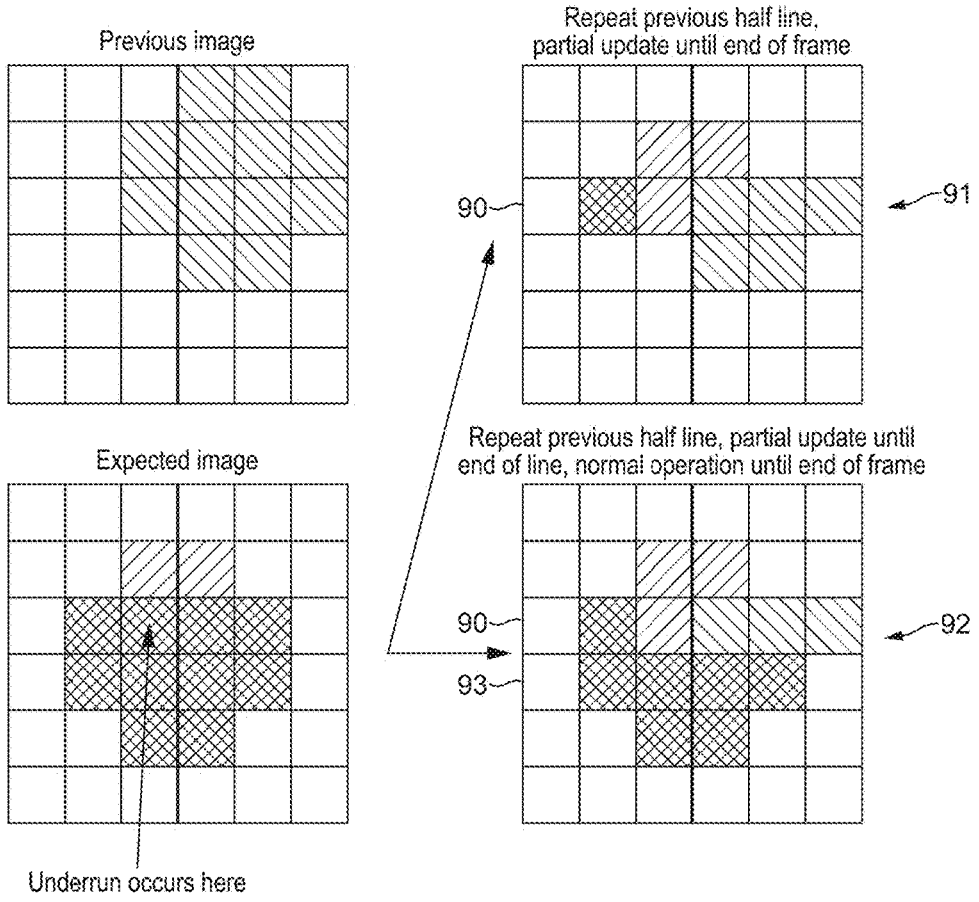

FIGS. 8 and 9 shows the operation in an embodiment of the technology described herein in a display system in which the display panel itself has an integrated local frame buffer that stores the data that is to be provided to the display panel, and so the display controller is operable to be able to "partially" update the frame buffer of the display panel, i.e. for those lines and/or parts of lines where new data is to be displayed.

In this case, as shown in FIG. 8, when underrun 80 occurs, the data from the previous line 81 is displayed for the remainder of the line 82 where the underrun occurred, and the display panel frame buffer 83 is not updated for the remaining lines 84 of the input layer (such that the remaining lines of the previous frame 85 remain being displayed).

FIG. 8 again shows for comparison purposes an arrangement 86 in which instead of using data from the previous line for a line in which underrun has occurred, the line in which underrun has occurred is simply padded with a background colour. Again, it can be seen that the arrangement in accordance with the technology described herein is more visually pleasing.

FIG. 9 shows a corresponding arrangement to FIG. 8, but in which it is possible to perform partial updates of the display panel frame buffer on a half-line (rather than only on a full line) basis.

Thus, as shown in FIG. 9, in this case, when underrun occurs, the relevant data from the previous half-line is reused in the half line 90 where underrun occurred.

FIG. 9 again shows two arrangements for this operation. In the first illustrated arrangement 91, there are no updates for the remaining lines of the input layer.

In the second illustrated arrangement 92, again when underrun occurs, the data from the previous half line is used for the half line 90 where underrun has occurred, and there is no update of the frame buffer for the remaining half of that line. However, for the next full line, 93, normal display panel frame buffer update operation is performed until the end of the frame.

It should be noted here that when an underrun occurs, it will take a certain amount of time for the latency buffer level to fill back up with data for providing to the display. In the second illustrated arrangement 92 shown in FIG. 9, it is assumed that the latency buffer level returns to a satisfactory level when the next half line is to be displayed. The more time it takes for the latency buffer to return to a satisfactory level, the fewer (half) lines will be output.

Where partial update operation is being performed, then in an embodiment it is signalled in advance how much data will be transferred to the display frame buffer in the next time period. In such an arrangement, if it is indicated that a large portion of data will be transferred, then there could be a risk of underrun in that portion of the data (in which event, in an embodiment data from the previous line is transferred in place of the "missing" data). Accordingly in an embodiment, where partial update of a local frame buffer of the display is being used, it is indicated that a relatively small portion of data (e.g. quarter of a line) will be sent, and if it is determined that an underrun may occur in the next such portion of data, it is signalled that the next portion of the line will not be updated. This will then reduce the risk of underrun occurring in a portion of data that it has already been indicated will be transferred to the local frame buffer of the display.

Although in the above embodiment, the system operates to fetch a reduced amount of data when a risk of underrun is identified, the operation of the data processing system and/or data processor can also or instead be modified in other ways when it is determined that there is a risk of underrun occurring, if desired.

For example, one or more of the display processor, interconnect, memory system, memory controller and memory (e.g. DDR-SDRAM) frequency could be increased in the event that a risk of underrun is detected; and/or pending memory transactions (for data to be displayed) could be terminated; and/or the generation of new such memory transactions stopped.

Similarly, while it would be possible simply to have a single threshold setting that is used to identify a risk of underrun, plural different thresholds (e.g. of available data in the local, e.g. latency hiding, buffer or buffers of the data processing system and/or display controller) could be set and used to identify a risk of underrun occurring, and, correspondingly, to trigger the modification of the operation of the display controller and/or data processing system accordingly.

For example, a first threshold level that is triggered when the amount of data in the local buffer (e.g. latency hiding buffer) falls below a first level, could trigger increasing the memory system and memory operation frequency, and/or fetching a reduced amount of data (and, in an embodiment, upscaling the fetched data), with a lower threshold amount of data (if met), then triggering stopping the generation of data requests (memory transactions) for data that will be likely to be returned from memory too late, and/or, for panels that support partial update, marking the next update region as not requiring an update.

A third threshold level for an even lower amount of (or zero) data could then be used to indicate that underrun is actually occurring, in response to which data that has previously been provided to the display is provided to the display in place of the "missing" data.

It can be seen from the above that embodiments of the technology described herein can provide an improved method and apparatus for recovering from display controller underrun and/or for reducing the likelihood of display controller underrun occurring in the first place.

This is achieved, in embodiments of the technology described herein, by redisplaying data from a previously displayed line in the event that underrun occurs, and/or reducing the resolution at which input layers are fetched in the event that a likelihood of underrun occurring is identified.

The foregoing detailed description has been presented for the purposes of illustration and description. It is not intended to be exhaustive or to limit the technology to the precise form disclosed. Many modifications and variations are possible in the light of the above teaching. The described embodiments were chosen in order to best explain the principles of the technology and its practical application, to thereby enable others skilled in the art to best utilise the technology in various embodiments and with various modifications as are suited to the particular use contemplated. It is intended that the scope be defined by the claims appended hereto.

What is claimed is:

1. A method of operating a display controller of a data processing system, the display controller being operable to fetch data for surfaces to be displayed from memory of the data processing system into a local buffer or buffers of the display controller and to provide data from the local buffer or buffers of the display controller to a display for display, the method comprising:

the display controller, when fetching the data for surfaces to be displayed from memory for display and providing that data to a display for display:

determining whether data to be provided to the display has been fetched into a local buffer of the display controller or not;

and when it is determined that the data to be provided to the display has not been fetched into the local buffer of the display controller, providing to the display in place of the data that has not been fetched into the local buffer of the display controller, data that has previously been fetched into the local buffer of the display controller;

determining, when fetching the data for the surfaces to be displayed from the memory for display, whether there is a risk that data to be subsequently provided to the display will not be fetched from the memory in time for it to be provided to the display, comprising determining that there is a risk that the data to be subsequently provided to the display will not be fetched from the memory in time for it to be provided to the display when data that has been fetched into the local buffer or buffers of the display controller that is still to be displayed falls below a threshold amount; and when it is determined, when fetching the data for the surfaces to be displayed from the memory for display, that there is a risk that the data to be subsequently provided to the display will not be able to be fetched from the memory in time for its display, modifying an operation of at least one of the display controller and the data processing system so as to reduce the risk that the data to be subsequently provided to the display will not be fetched from the memory in time for it to be provided to the display, the modifying comprising:

reducing the amount of data that needs to be fetched from the memory into the local buffer or buffers of the display controller for one or more of the surfaces to be displayed compared to the amount of data that was to be fetched from the memory for the one or more of the surfaces to be displayed; and using that reduced amount of data for displaying the one or more of the surfaces to be displayed.

2. The method of claim 1, wherein the local buffer of the display controller that the data for surfaces to be displayed is fetched into comprises a latency hiding buffer of the display controller, an output line buffer of the display controller, another line buffer of the display controller, or a frame buffer that is provided locally to the display that the display controller is providing data for display to.

3. The method of claim 1, comprising:

determining whether the data to be provided to the display has been fetched into the local buffer of the display controller or not by:

tracking the fetching of the data from the memory into the local buffer or buffers of the display controller; and determining therefrom whether the data to be provided to the display has been fetched into the local buffer of the display controller.

4. The method of claim 1, comprising:

determining whether the data to be provided to the display has been fetched into the local buffer of the display controller or not by:

determining whether data to be read from the local buffer of the display controller and provided to the display was present in the local buffer of the display controller when a read operation for that data was performed.

5. The method of claim 1, wherein:

the data that has previously been fetched into the local buffer of the display controller that is provided to the display in place of the data that has not been fetched into the local buffer of the display controller when it is determined that the data to be provided to the display has not been fetched into the local buffer of the display controller comprises one of:

data from a previously displayed line of the surface that the data that has not been fetched into the local buffer relates to; and data from a line of a previously displayed surface.

6. A display controller for a data processing system, the display controller comprising:

one or more local buffers;

memory read circuitry operable to fetch data of input surfaces to be processed by the display controller from memory into the local buffer or buffers of the display controller; and processing circuitry operable to provide the data of input surfaces from the local buffer or buffers of the display controller to a display for display;

wherein:

the display controller is operable to, when fetching the data of input surfaces from memory for display and providing that data to a display for display:

determine whether data to be provided to the display has been fetched into a local buffer of the display controller or not;

and when it is determined that the data to be provided to the display has not been fetched into the local buffer of the display controller, provide to the display in place of the data that has not been fetched into the local buffer of the display controller, data that has previously been fetched into the local buffer of the display controller;

determine, when fetching the data for surfaces to be displayed from the memory for display, whether there is a risk that data to be subsequently provided to the display will not be fetched from the memory in time for it to be provided to the display, comprising determining that there is a risk that the data to be subsequently provided to the display will not be fetched from the memory in time for it to be provided to the display when data that has been fetched into the local buffer or buffers of the display controller that is still to be displayed falls below a threshold amount; and when it is determined, when fetching the data for surfaces to be displayed from the memory for display, that there is a risk that the data to be subsequently provided to the display will not be able to be fetched from the memory in time for its display, modify an operation of at least one of the display controller and the data processing system so as to reduce the risk that the data to be subsequently provided to the display will not be fetched from the memory in time for it to be provided to the display, the modifying comprising:

reducing the amount of data that needs to be fetched from the memory into the local buffer or buffers of the display controller for one or more of the surfaces to be displayed compared to the amount of data that was to be fetched from the memory for the one or more of the surfaces to be displayed; and using that reduced amount of data for displaying the one or more of the surfaces to be displayed.

7. The display controller of claim 6, wherein the local buffer of the display controller that the data of input surfaces is fetched into comprises a latency hiding buffer of the display controller, an output line buffer of the display controller, another line buffer of the display controller, or a frame buffer that is provided locally to the display that the display controller is providing data for display to.

8. The display controller of claim 6, wherein the display controller is operable to:

determine whether the data to be provided to the display has been fetched into the local buffer of the display controller or not by:

tracking the fetching of the data from the memory into the local buffer or buffers of the display controller; and determining therefrom whether the data to be provided to the display has been fetched into the local buffer of the display controller.

9. The display controller of claim 6, wherein the display controller is operable to:

determine whether the data to be provided to the display has been fetched into the local buffer of the display controller or not by:

determining whether data to be read from the local buffer of the display controller and provided to the display was present in the local buffer of the display controller when a read operation for that data was performed.

10. The display controller of claim 6, wherein:

the data that has previously been fetched into the local buffer of the display controller that is provided to the display in place of the data that has not been fetched into a local buffer of the display controller when it is determined that the data to be provided to the display has not been fetched into the local buffer of the display controller comprises one of:

data from a previously displayed line of the surface that the data that has not been fetched into the local buffer relates to; and data from a line of a previously displayed surface.

11. A non-transitory computer readable storage medium storing computer software code which when executing on one or more processors performs a method of operating a display controller of a data processing system, the display controller being operable to fetch data for surfaces to be displayed from memory of the data processing system into a local buffer or buffers of the display controller and to provide data from the local buffer or buffers of the display controller to a display for display, the method comprising:

the display controller, when fetching the data for surfaces to be displayed from memory for display and providing that data to a display for display:

determining whether data to be provided to the display has been fetched into a local buffer of the display controller or not;

and when it is determined that the data to be provided to the display has not been fetched into the local buffer of the display controller, providing to the display in place of the data that has not been fetched into the local buffer of the display controller, data that has previously been fetched into the local buffer of the display controller;

determining, when fetching the data for surfaces to be displayed from the memory for display, whether there is a risk that data to be subsequently provided to the display will not be fetched from the memory in time for it to be provided to the display, comprising determining that there is a risk that the data to be subsequently provided to the display will not be fetched from the memory in time for it to be provided to the display when data that has been fetched into the local buffer or buffers of the display controller that is still to be displayed falls below a threshold amount; and when it is determined, when fetching the data for surfaces to be displayed from the memory for display, that there is a risk that the data to be subsequently provided to the display will not be able to be fetched from the memory in time for its display, modifying an operation of at least one of the display controller and the data processing system so as to reduce the risk that the data to be subsequently provided to the display will not be fetched from the memory in time for it to be provided to the display, the modifying comprising:

reducing the amount of data that needs to be fetched from the memory into the local buffer or buffers of the display controller for one or more of the surfaces to be displayed compared to the amount of data that was to be fetched from the memory for the one or more of the surfaces to be displayed; and using that reduced amount of data for displaying the one or more of the surfaces to be displayed.

* * * * *